US009693152B2

(12) United States Patent
Sabin

(10) Patent No.: US 9,693,152 B2
(45) **Date of Patent: *Jun. 27, 2017**

(54) HEARING ASSISTANCE DEVICE CONTROL

(71) Applicant: Northwestern University, Evanston, IL (US)

(72) Inventor: Andrew Sabin, Chicago, IL (US)

(73) Assignee: Northwestern University, Evanston, IL (US)

( * ) Notice: Subject to any disclaimer, the term of this patent is extended or adjusted under 35 U.S.C. 154(b) by 62 days.

This patent is subject to a terminal disclaimer.

(21) Appl. No.: 14/825,705

(22) Filed: Aug. 13, 2015

(65) Prior Publication Data

US 2015/0350795 A1 Dec. 3, 2015

Related U.S. Application Data

(63) Continuation of application No. 14/258,825, filed on Apr. 22, 2014, now Pat. No. 9,131,321.

(60) Provisional application No. 61/828,081, filed on May 28, 2013.

(51) Int. Cl.
*H04R 25/00* (2006.01)

(52) U.S. Cl.
CPC ..... *H04R 25/50* (2013.01); *H04R 25/70* (2013.01); *H04R 2225/55* (2013.01)

(58) Field of Classification Search
CPC ..... H04R 25/50
USPC ..... 381/312, 314, 60
See application file for complete search history.

(56) References Cited

U.S. PATENT DOCUMENTS

| | | | | |
|---|---|---|---|---|
| 5,880,392 | A | 3/1999 | Wessel et al. | |
| 6,175,635 | B1 | 1/2001 | Meyer et al. | |
| 7,054,449 | B2 | 5/2006 | Ludi | |
| 7,349,549 | B2 | 3/2008 | Bachler et al. | |
| 8,135,138 | B2 | 3/2012 | Wessel et al. | |
| 9,131,321 | B2 * | 9/2015 | Sabin | H04R 25/50 |
| 2003/0072465 | A1 * | 4/2003 | Fischer | H04R 25/43 381/317 |
| 2004/0071304 | A1 | 4/2004 | Yanz et al. | |

(Continued)

FOREIGN PATENT DOCUMENTS

| | | |
|---|---|---|
| EP | 2031900 | 7/2013 |
| WO | WO 9919779 | 4/1999 |

OTHER PUBLICATIONS

Allen JB, Hall JL, Jeng PS, Loudness growth in 112-Octave bands (LGOB)—a procedure for the assessment of loudness, The Journal of the Acoustical Society of America, 1990, 88:745-753.

(Continued)

*Primary Examiner* — Paul S Kim
*Assistant Examiner* — Katherine Faley
(74) *Attorney, Agent, or Firm* — Fish & Richardson P.C.

(57) ABSTRACT

A hearing assistance device may be a hearing aid worn on a person or a mobile device. The hearing assistance device may perform a hearing assistance algorithm based on signal processing parameters. A set of audiological values for a population may be identified. The set of audiological values has a first number of dimensions. The set of audiological values is converted to a reduced data set. The reduced data has set has a second number of dimensions less than the first number of dimensions. A processor calculates a trajectory for the reduced data set. The trajectory provides signal processing parameters for the hearing assistance device.

14 Claims, 13 Drawing Sheets

(56) References Cited

U.S. PATENT DOCUMENTS

| | | | | |
|---|---|---|---|---|
| 2007/0076909 | A1 | 4/2007 | Roeck et al. | |
| 2009/0060214 | A1 | 3/2009 | Wessel et al. | |
| 2010/0098276 | A1 | 4/2010 | Frohlich et al. | |
| 2010/0234757 | A1* | 9/2010 | Stromsted | H04R 25/70 600/559 |
| 2010/0280307 | A1 | 11/2010 | Lineaweaver et al. | |
| 2010/0284556 | A1* | 11/2010 | Young | H04R 25/558 381/314 |
| 2011/0038498 | A1 | 2/2011 | Edgar | |
| 2011/0051942 | A1 | 3/2011 | Wilson | |

OTHER PUBLICATIONS

Atcherson S. Spann, M. Johnson, 12 Apps to help you hear better, Hearing Health Magazine, 2012, Spring 2012, Hearing Health Foundation.

Basskent D., Eiler CL, Edwards B., Using genetic algorithms with subjective input from human subjects: implications for fitting hearing aids and cochlear implants, Ear and Hearing, 2007, 28:370-380.

Birlutiu A., Groot P., Heskes T., Multi-task Preference Learning with an Application to Hearing-Aid Personalization, Neurocomputing, 2010, 73:1177-1185.

Byrne D., Dillon H., The National Acoustic Laboratories (NAL) New procedure for selecting the gain and frequency response of a hearing aid, Ear and Hearing, 1986, 7:257-265.

Byrne D., Parkinson A., Newall P, Hearing aid gain and frequency response requirements for the severely/profoundly hearing impaired, Ear and Hearing, 1991, 11:40-49.

Byrne D., Tonnison W, Selecting the gain of hearing aids for persons with sensorineural hearing impairments, Scandinavian Audiology, 1976, 5:51-59.

Ciletti L., Flamme GA, Prevalence of hearing impairment by gender and audiometric configuration: results from 9 National Health and Nutrition Examination Survey (1999-2004) and the Keokuk County Rural Health Study (1994-1998), Journal of the American Academy of Audiology, 2008, 19:672-685.

Clasen T., Vesterager V., Parving A., In-the-ear hearing aids. A comparative investigation of the use of custom-made versus modular type aids, Scandinavian Audiology, 1987, 16:195-200.

Cornelisse LE, Seewald RC, Jamieson DG, The input/output formula: a theoretical approach to the fitting of personal amplification devices, The Journal of the Acoustical Society of America, 1995, 97:1854-1864.

COX RM, Preferred hearing aid gain in everyday environments, Ear and Hearing, 1991, 12:123-126.

COX RM, Using loudness data for headng aid selection: The IHAFF approach, The Hearing Journal, 1995, 10.

Darke G, Assessment of timbre using verbal attributes, 2005, Conference on Interdisciplinary Musicology, Montreal, Quebec.

Dillon H, NAL-NLI: A new prescriptive fitting procedure for non-linear hearing aids, Hearing Journal, 1999, 52:10-16.

Dillon H, Zakis JA, Mcdermott H J, Keidser G, Dsreschler WA, The trainable hearing aid: What will it do for clients and clinicians, The Hearing Journal, 2006, 30-36.

Disley AC, Howard DM, HtJNDT AD, Timbral description of musical instruments, International Conference on Music Perception and Cognition, 2006, 61-68, Bologna, Italy.

Disley AC, Howard DM, Spectral correlates of timbral semantics relating to the pipe organ, Joint Baltic-Nordic Acoustics Meeting Marichamn, Aland, 2004.

Drsechler WA, Keidser G, Convery E, Dillon H, Client-based adjustments of hearing aid gain: the effect of different control configurations, Ear and hearing, 2908, 29:214-227.

Durant EA, Wakefield GH, Van Tasell D J, Rickert ME, Efficient perceptual tuning of hearing aids with genetic algorithms, Speech and Audio Processing, IEEE Transactions on, 2004, 12:144-155.

Franck BA, Dreschler WA, Lyzenga J, Methodological aspects of an adaptive multidirectional pattern search to optimize speech perception using three hearing-aid algorithms, J Acoust Soc Am, 2004, 116:3620-3628.

Gilbert G, Akeroyd MA, Gatehouse S, Discrimination of release time constants in hearing-aid compressors, International Journal of Audiology, 2008, 47:189-198.

Heskes T, Dijkstra T, Kates J, Predicting preference judgments of individual normal and hearing-impaired 23 listeners with Gaussian processes, IEEE Transactions on Audio, Speech, and Language Processing, 2011, 19:811-821.

Hornsby BW, Mueller HG, User preference and reliability of bilateral hearing aid gain adjustments, Journal of the American Academy of Audiology, 2008, 19:158-170.

Jenstad LM, Hearing Aid Troubleshooting Based on Patients' Descriptions, J Am Acad Audiol, 2003, 14:347-360.

Keidser G, O'Brien A, Carter L, McLelland M, Yeend I, Variation in preferred gain with experience for hearing-aid users, International Journal of Audiology, 2008, 47:621-635.

Keidser G., Convery E., Dillon H, Potential Users and Perception of a Self-Adjustable and Trainable Hearing Aid; A consumer survey, Hearing Review, 2007, 14:31-34.

Keidser.G., Dillon H., Flax M., Ching T., Brewer S., The NAL-NL2 prescription procedure, Audiology Research, 2011, 1:68-90.

Kiessling J, Schubert M, Archut A, Adaptive fitting of hearing instruments by category loudness scaling, (ScalAdapt). Scandinavian audiology, 1996, 25:153-160.

Killion M, Fikret-Pasa S, The 3 types of sensorineural hearing loss: loudness and intelligibility considerations, The Hearing Journal, 1993, 46:31-36.

Kochin S, MarkeTrak III Why 20 Million in U.S. don't use hearing aids for their hearing loss, Hearing Journal, 1993, 46:20-27.

Kochin S, MarkeTrak IV: Correlates of hearing aid purchase intent, Hearing Journal, 1998, 51:30-41.

Kochkin S, MarkeTrack VIII: The Key Influencing Factors in Hearing Aid Purchase Intent, Hearing Review, 2012, 19:12-25.

Kochkin S, MarkeTrak VII Obstacles to adult non-user adoption of hearing aids, Hearing Journal, 2007, 60:24-51.

Kochkin S, MarkeTrak VIII: 25-year trends in hearing health market, Hearing Review, 2909, 16:12-31.

Kuk F, How flow charts can help you troubleshoot hearing aid problems, Hear J, 1999, 52:46-52.

Kuk FK, Eape NM, The reliability of a modified simplex procedure in hearing aid frequency, Journal of Speech and 38 Hearing Research, 1992, 35:418-429.

Leijon A, Eriksson-Mangold M, Bech-Karlsen A, Preferred hearing aid gain and bass-cut in relation to precriptive fitting, Scandinavian Audiology, 1984, 13:157-161.

McCandless G, Lyregarrd P, Prescription of gain/output (POGO) for hearing aids, Hearing Instruments, 1983, 31:16-21.

Moore BC, Alcantara JI, Glasberg BR, Development and evaluation of a procedure for fitting multi-channel compression hearing aids, British Journal of audiology, 1998, 32:177-195.

Moore BC, Marriage J, Alcantara J, Glasberg BR, Comparison of two adaptive procedures for fitting a multi-channel compression hearing aid, Int. J. Audiol., 2005, 44:345-357.

Moore BCJ, Glasberg BR, Baer, A model for the prediction of thresh holds, loudness, and partial loudness, Journal of the Audio Engineering Society, 1997, 45:224-240.

Mueller H, Fitting Hearing aids to adults using prescriptive methods: An evidence-based review, Journal of the American Academy of Audiology, 2005, 16:448-460.

Mueller HG, Hornsby BW, Weber K, Using trainable hearing aids to examine real-world preferred gain, Journal of the American Academy of Audiology, 2008, 16:448-460.

Neumann AC, Levitt H., Mills R., Schwander T., An evaluation o1 three adaptive hearing aid selection strategies, J Acoust Soc Am, 1987, 82:1967-1976.

Pluvinage V, Clinical measurement of loudness, Hear Instrum, 1989, 40:28-34.

Rasmussen, AN, Osterhammel PA, Andersen T, Poulsen T, Auditory models and non-linear hearing instruments, Aarhus: The Danavox Jubilee Foundation, 1999, 439.

Sabin A, Hardies L, Marrone N., Dhar S, Weighting Function-Based Mapping of Descriptors to Frequency-Gain Curves in Listeners With Hearing Loss, Ear and Hearing, 2011a, 32:399-409.

(56) References Cited

OTHER PUBLICATIONS

Sabin A, Rafii Z, Pardo B, Weighting-Function-Based Rapid Mapping of Descriptors to Audio Processing Parameters, Journal of the Audio Engineering Society, 2011b, 59:419-430.
Schwartz DM, Lyregaard P, Lundh P, Hearing aid selection for severe-to-profound hearing loss, The Hearing 55 Journal, 1988, 41:13-17.
Schwartz DM, Lyregaard P, Lundh P, Hearing aid selection for severe-to-profound hearing loss, The Hearing Journal, 1988, 41:13-17.
Schweitzer C, Mortz M, Vaughan N, Perhaps not by prescription, but by perception, High Performance Hearing Solutions, 1999, 3:58-62.
Scollie S, Seewald R, Cornelisse L, Moodie S, Bagatto M, Laurnagaray D, Beaulac S, Pumford J, The Desired Sensation Level multistage input output algorithm, Trends in Amplification, 2905, 9:159-197.
Shapiro I, Hearing aid fitting by prescription, Audiology: official organ of the International Society of Audiology, 1976, 15:163-173.
Smale EL , McDonald S , Dhar V , Differentiating tonsillitis from glandular fever: is the lymphocyte white blood cell count ratio any help, Archives Otolaryngology—Head and Neck Surgery, 2007, 133:952.
Stelmachowicz PG, Lewis DE, Carney E, Preferred hearing-aid frequency responses in simulated listening environments, Journal of Speech and Hearing Research, 1994, 37:712-719.
Valente M., Van Vliet D. The independent hearing aid fitting forum (IHADD) protocol, Trends in Amplification, 1997, 2:6-35.
Zakis JA, Dillon H, McDermott H J, The design and evaluation of a hearing aid with trainable amplification parameters, Ear and Hearing, 2007, 28:812-830.
International Search Report and Written Opinion; PCT/US2015/027118; Jul. 28, 2015; 17 pp.
Amlani A., Taylor B., Three Known Factors That Impede Hearing Aid Adoption Rates, Hearing Review, 2012, 19:28-37.
Kochkin S, MarkeTrak IV: Correlates of hearing aid purchase intent, Hearing Journal, 2000, 51:30-38.
Nabelek, V., Discriminability of the quality of amplitude-compressed speech, Journal of Speech and Hearing Research, 1984, 27:571-577.
NIDCD, http://www.nidcd.nih.gov/health/statistics/long-hearingaids.aspx; as retrieved on Jan. 4, 2017.
NIDCD, http://www.nidcd.nih.gov/health/statistics/quick-statistics-hearing; as retrieved on Jan. 4, 2017.
Pascoe, An approach to hearing aid selection, Hear Instrum., 1978, 29:12-16.

* cited by examiner

HEARING ASSISTANCE DEVICE CONTROL

RELATED APPLICATIONS

The present patent application is a continuation of U.S. Ser. No. 14/258,825, filed on Apr. 22, 2014, which claims the benefit of the filing date under 35 U.S.C. §119(e) of U.S. Provisional Patent Application Ser. No. 61/828,081, filed May 28, 2013, which is hereby incorporated by reference herein in its entirety.

This invention was made with government support under R44 DC013093 (Ear Machine LLC, SBIR subcontract to Northwestern University, Agreement May 24, 2013) awarded by the National Institutes of Health. The government has certain rights in the invention.

TECHNICAL FIELD

This disclosure relates in general to the field of hearing assistance devices, and more particularly, to a mobile device for hearing assistance device control that is user configurable.

BACKGROUND

In the United States, where more than 36 million people require treatment for their hearing loss, only 20% actually seek help. The high out of-pocket cost of hearing assistance devices consistently shows up as one of the major obstacles to treatment. In countries where such costs are lower or nonexistent, adoption rates for hearing treatment are often between 40 and 60%. In the United States, some of the factors that drive up the cost of hearing assistance devices are diagnosis, selection, fitting, counseling, and fine tuning.

The process of purchasing and configuring a hearing assistance device is time consuming and expensive. Every patient's hearing loss is different. In many cases, people with hearing loss hear loud sounds normally but have can not detect quieter sounds. Hearing loss also varies across frequency.

No hearing aids can truly correct a hearing loss. However, the configuration of a hearing aid to the patient's needs is critical for a successful outcome. Typically, a patient visits a hearing aid specialist and receives a hearing test. Various tones are played for the patient, and the hearing aid is configured according to the patient's responsiveness to the various tones and at various sound levels.

The initial configuration of the hearing aid is usually not acceptable to the patient. The patient returns and provides feedback to the hearing aid specialist (e.g., the sound is too "tinny," the patient cannot hear televisions at normal levels, or restaurant noise is overwhelming). The hearing aid specialist makes adjustments in the tuning of the hearing aid. Although this iterative approach can be effective, the approach is limited by the patient's ability to convey the shortcomings of the hearing aid setting with language, and the ability of the hearing aid specialists to translate that language into hearing aid settings. Often, many follow-up visits are necessary, adding cost and time to an already uncomfortable process for the patient.

BRIEF DESCRIPTION OF THE DRAWINGS

Exemplary embodiments of the present embodiments are described herein with reference to the following drawings.

DESCRIPTION OF EXAMPLE EMBODIMENTS

In the typical distribution channel, users of hearing assistance devices may be given limited or no control over the signal processing parameter values (e.g., digital signal processing (DSP) values) that influence the sound of the assistance devices. In most cases, users can only change overall sound level. This is problematic because many of the signal processing parameters other than overall level can dramatically influence the success that the patient has with the hearing assistance device.

Adjustment of the signal processing parameter values may be done by a clinician. This is problematic because the adjustments are costly (requiring clinician hours) and might not address the user's concerns because the adjustments rely on imprecise memory and language. It is also not feasible to give the user control of all signal processing parameter values because of the esoteric nature of DSP techniques. In addition, there can be a large number of parameter values (e.g., greater than 100).

The following example embodiments facilitate user adjustment of hearing assistance devices to reduce key components of the current cost barrier that excludes some patients from the hearing aid market. The example embodiments may increase the efficacy of both traditional treatment flows through audiologists and hearing aid dispensers, as well as facilitate the distribution of hearing aids directly to consumers. Described here is a method and system for fitting and adjusting hearing assistance devices that is centered on user-based adjustment. The example embodiments include one or more controllers, each controller affecting numerous signal processing parameter values. The technology could be used either in conjunction with clinician hearing aid fitting, or as a stand-alone technique or device.

The following examples simplify the process and enable a paradigm in which the user adjusts the sound of the hearing assistance device by adjusting one or more simple controllers that each manipulates numerous signal processing parameter values. The examples may include combinations of signal processing parameter values and placing the combinations on a perceptually relevant dimension. In one example, the perceptually relevant dimension may be a dimension based on auditory similarity between adjacent sets of the signal processing parameter values. A personal computer, mobile device, or another computing device may display a user interface that is specifically formulated to accommodate users with poorer-than-normal dexterity, which is a common attribute of older individuals with impaired hearing.

Figure 1A:
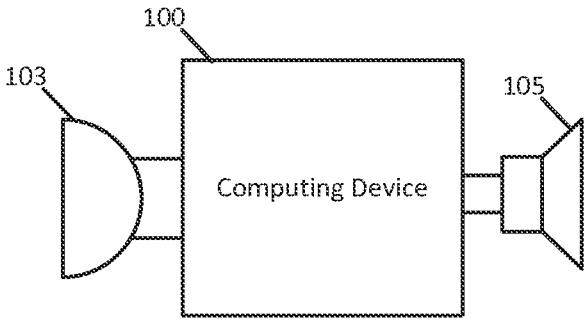
FIG. 1A illustrates an example system for hearing assistance device control.

FIG. 1A illustrates an example system for hearing assistance device control. The system includes a computing device 100, a microphone 103, and a speaker 105. The computing device 100 is electrically coupled (e.g., through a wire or a wireless signal) to the microphone 103 and the speaker 105. Additional, different, or fewer components may be included. The computing device 100 may be a personal computer or a mobile device. The mobile device may be a handheld device, such as a smart phone, a mobile phone, a personal digital assistant, or a tablet computer. Other example mobile devices may include a tablet computer, a wearable computer, an eyewear computer, or an implanted computer. The microphone 103 and the speaker 105 may reside in earphones with built in microphone that plugs into the earphone jack of the mobile device or communicates wirelessly with the mobile device.

The computing device 100 may function as a hearing assistance device. The computing device 100 may be configured to receive audio signals through the microphone 103, modify the audio signals according to a hearing assistance algorithm, and output the modified audio signal—all in real time or near real time. Near real time may mean within a small time interval (e.g., 50, 200 or 500 msec). The computing device 100 includes a user interface including at least one control input for settings of the hearing assistance algorithm.

A control input moves along a trajectory in which each point along that trajectory corresponds to an array of signal processing parameter values affecting a hearing assistance algorithm. The trajectory may be a single dimensional path through a multi-dimensional data set. The multi-dimensional data set may be reduced from a set of audiological values for a population. The population may refer to a population of humans with varying hearing loss that have provided data related to optimal or estimated hearing assistance values. The population may refer to a population of data samples that may have been determined to be representative of a target population according to the statistical algorithm.

Figure 1B:
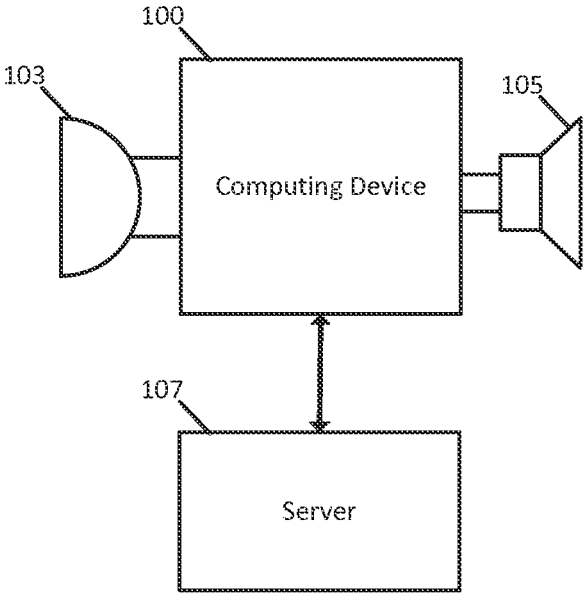
FIG. 1B illustrates another example system for hearing assistance device control.

FIG. 1B illustrates another example system for hearing assistance device control. The system includes a server 107, a computing device 100, a microphone 103, and a speaker 105. The computing device 100, which may include any of the alternatives above, is electrically coupled to the microphone 103 and the speaker 105. Additional, different, or fewer components may be included.

The server 107 may be any type of network device configured to communicate with the computing device over a network. The server 107 may be a gateway, a proxy server, a distributed computer, a website, or a cloud computing component. The network may include wired networks, wireless networks, or combinations thereof. The wireless network may be a cellular telephone network, an 802.11, 802.16, 802.20, or WiMax network. Further, the network may be a public network, such as the Internet, a private network, such as an intranet, or combinations thereof, and may utilize a variety of networking protocols now available or later developed including, but not limited to TCP/IP based networking protocols.

The server 107 may be configured to define mapping from controller position to the signal processing parameter values of the hearing assistance algorithm. For example, the server 107 may receive the audiological values from a database. The server 107 may analyze audiological values to calculate the hearing assistance algorithm. For example, the server 107 may perform a dimension reduction on the audiological values to derive a single dimensional path (e.g., curve or line) through the audiological values.

Figure 2A:
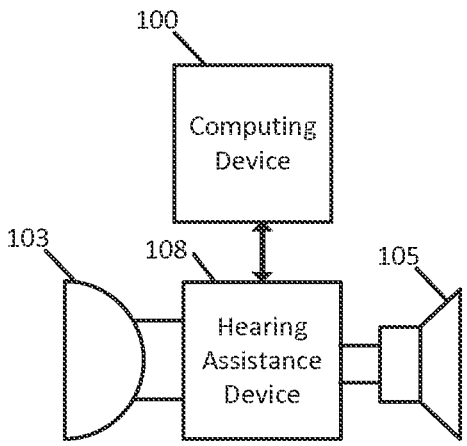
FIG. 2A illustrates another example system for hearing assistance device control.

FIG. 2A illustrates another example system for hearing assistance device control. The system includes a separate hearing assistance device 108 coupled (e.g., through a cable or wirelessly) to the computing device 100. The computing device 100 may include s microphone 103 and a speaker 105. Additional, different, or fewer components may be included. The hearing assistance device 108 may be any devices that can pick up, process, and deliver to the human auditory system ambient sounds around the user. Examples for the hearing assistance device 108 include hearing aids, personal sound amplifier products, cochlear implants, middle ear implants, smartphones, headsets (e.g., Bluetooth), and assistive listening devices.

The hearing assistance device 108 may be classified according to how the device is worn. Examples include body worn aids (e.g., the hearing assistance device 108 fits in a pocket), behind the ear aids (e.g., the hearing assistance device 108 is supported outside of the human ear), in the ear aids (e.g., the hearing assistance device 108 is supported at least partially inside the ear canal), and anchored ear aids (e.g., the hearing assistance device 108 is surgically implanted and may be anchored to bone).

The hearing assistance device 108 may receive audio signals through the microphone 103, modify the audio signals according to a hearing assistance algorithm, and output the modified audio signals. The computing device 100 includes a user interface including at least one control input for settings used to define the hearing assistance algorithm. The settings for the hearing assistance algorithm are transmitted from the computing device 100 to the hearing assistance device 108 and stored in memory by the hearing assistance device 108. The bi-directional communication between the computing device 100 and the hearing assistance device 108 may be a wired connection or a wireless connection using a radio frequency signal, one of the family of protocols known as Bluetooth, or one of the family of protocols known as IEEE 802.11.

Figure 2B:
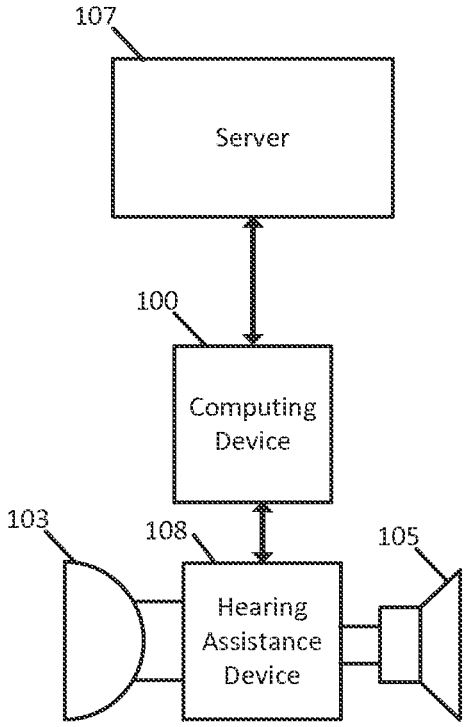
FIG. 2B illustrates another example system for hearing assistance device control.

FIG. 2B illustrates another example system for hearing assistance device control. The system includes a server 107 in addition to a separate hearing assistance device 108 electrically coupled to the computing device 100. Additional, different, or fewer components may be included.

In one example, the server 107 calculates a controller-position-to-signal-processing-parameter-value mapping from audiological values. The server 107 downloads the mapping including multiple settings to the computing device 100. The computing device 100 includes a user interface including at least one control input for settings used to define the mapping. The mapping is transmitted from the computing device 100 to the hearing assistance device 108 and stored in memory by the hearing assistance device 108. The hearing assistance device 108 may receive audio signals through the microphone 103, modify the audio signals according to a hearing assistance algorithm, and output the modified audio signals.

Figure 3:
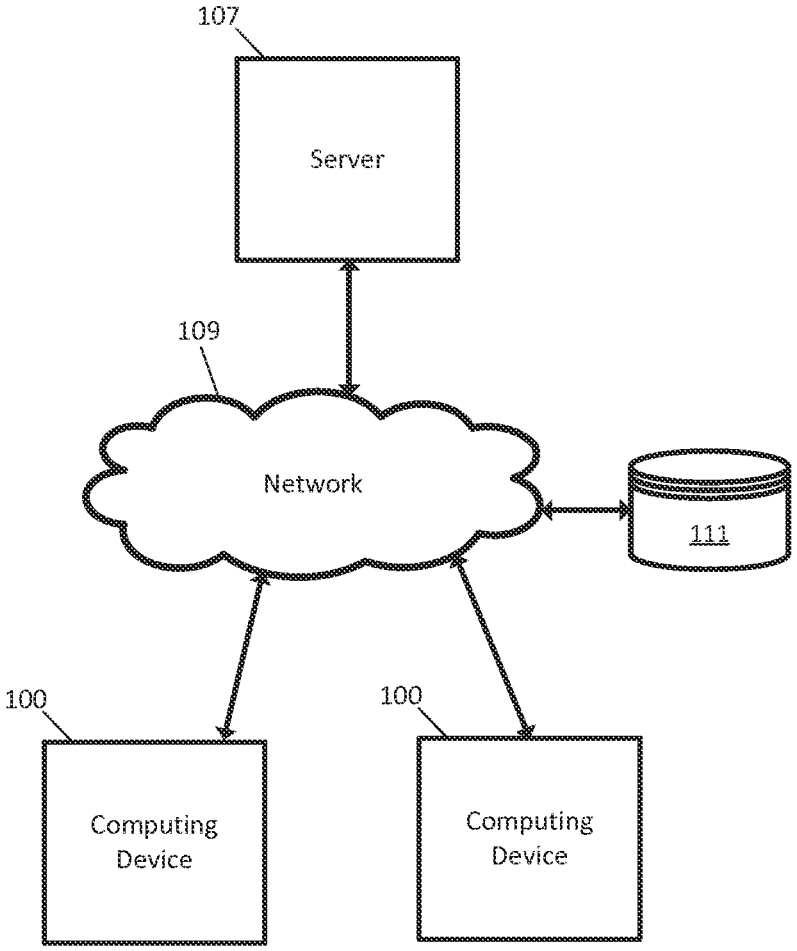
FIG. 3 illustrates an example network including the system for hearing assistance device control.

FIG. 3 illustrates an example network 109 including the system for hearing assistance device control. The network 109 may include any of the network examples above. The server 107 may collect the set of audiological values from multiple computing devices 100 through the network 109. The computing devices 100 may include a testing mode in which users or clinicians provide optimal audiological values.

In another example, the server 107 may query a database 111 for the audiological values, and the database 111 sends the audiological values to the server 107. The audiological values may include audiograms, signal processing values, target electroacoustics, or another data set. The audiological values may include hearing aid prescription values compiled by hearing aid manufactures or clinicians.

The set of audiological values may be defined according to a population. The population may be a population of possible dataset values. The population may be based on a group of humans. The group of humans may be defined by a set of target users such as all individuals, all hearing aid users, only individual with moderate loss, only individuals with severe loss, only individuals with mild loss, or another set of users.

Example sources (e.g., database 111) for the set of audiological values include the National Health and Nutrition Examination Survey (NHANES) database from the Centers for Disease Control and the presbyacusis model from the International Standards Organization.

The server 107 may perform a statistical algorithm on the audiological values. Example statistical algorithms include clustering algorithms, modal algorithms, a dimension reduction algorithm, or another technique for identifying a representative data set from the audiological values. The statistical algorithm may divide the audiological data into a predetermined number (e.g., 10, 20, 36, 50, 100, or another value) of groups.

If included, the clustering algorithm may organize the audiological values into groups such that data values in a cluster or more like other data values in the cluster than data values in other clusters. Example clustering algorithms include centroid based clustering, distribution based clustering, and k-means clustering.

Example modal algorithms organize the set of audiological values based on the most likely occurring values. For example, the audiological values may be divided into ranges in the total span of the data. The quantity of the ranges selected may be the predetermined number (e.g., 10, 20, 36, 50, 100, or another value) of groups. The ranges having the most values in them may be selected. For example, the data values may be divided into 100 equally spaced ranges, and the 36 ranges with the most data points are selected as the representative data set.

Additional dimension reduction techniques include principal component analysis and self-organizing maps (SOMs) which may be used to organize the audiological values into the representative data set. Self-organizing maps include methods in which a number of nodes are arranged in a low-dimensional geometric configuration. Each node stores a function. When training data are presented to the SOM, the node with the function that is the closest fit to the item is identified and that function is changed to be more similar to the example. Further, the functions in the 'neighboring' nodes also change their stored function, but the influence of the training example on the stored function decreases as the distance increases. Over time, the high-dimensional dataset is represented in low dimensional space. The stored functions in each node are representative of the larger data set The audiological values may be audiograms, which is the function or set of data that describes that quietest detectable tone (via air- and bone-conduction) by a user as a function of frequency. The audiological values may be target electroacoustic performance, signal processing parameters or signal processing parameters may be derived from the audiological values (for instance using a hearing aid prescription algorithm). The transformation of audiograms into signal processing parameters may occur before or after the data set is modified using the statistical algorithm.

The term signal processing parameters may refer to the parameters of the algorithms used in hearing devices that change the output of those devices. The signal processing parameters may influence digital signal processing parameters such as gain, compression ratio, compression threshold, compression attack time, compression release time, limiter threshold, limiter ratio, limiter attack time, and limiter release time. Each of these parameters can be defined on a frequency-band-specific basis.

The compression threshold is the value of the sound level of the input (usually specified in decibels, often decibels sound pressure level) above which the compression becomes active.

The compression ratio is the relationship between the amount by which the input exceeds the compression threshold (the numerator) and the amount by which the output should exceed that threshold (the denominator). Both the numerator and denominator may be expressed in decibels.

The compression attack time and limiter attack time are the time constants that specify how quickly compression should be engaged once the input signal exceeds the compression threshold.

The compression release time and limiter release time are the time constants that specify how quickly compression should be dis-engaged once the input signal falls below the compression threshold. The limiter threshold is the value of the sound level of the input (usually specified in decibels, often decibels sound pressure level) above which the limiting becomes active.

The limiter ratio is the relationship between the amount by which the input exceeds the limiter threshold (the numerator) and the amount by which the output should exceed that threshold (the denominator). Both the numerator and denominator are usually expressed in decibels. In the case of limiting the ratio can be very high and in the extreme case reaches a value of infinity to 1.

It is also recognized that the signal processing can be done in the digital or analog domains. A combination of signal processing parameter values may define an output from a hearing aid prescription.

Hearing aid prescription refers to a wide variety of techniques in which some measurement of an individual's auditory system is used to determine the target electroacoustic performance of a hearing device that is appropriate for that individual. The measurement is typically the audiogram, which is the quietest sound that can be detected by the individual as a function of frequency (e.g., combinations of sound levels and frequency values). The sound levels are typically described in dB HL (decibels hearing loss)—a scale in which 0 dB HL is the sound level for which people with normal can reliably detect the tone. Many hearing aid prescriptions have been developed including, but not limited to, NAL-NL1, NAL-NL2, NAL-RP, DSL (i/o), DSL 5, CAM, CAM2, CAM2-HF, and POGO. Target electroacoustic performance refers to the desired electroacoustic output of a hearing device or the hearing assistance algorithm for a specified input. The input may take a wide variety of forms such as a pure tone of a particular frequency at a particular input level, or a speech-shaped noise at a particular input level. Similarly output can be specified in terms of values such as real ear insertion gain (as described by ANSI S3.46-1997), real ear aided gain (as described by ANSI 53.46-1997), 2 cc coupler gain (as in insertion gain, but sound level measured in a 2 cc coupler rather than a real ear), and real ear saturation response (SPL, as a function of frequency, at a specified measurement point in the ear canal, for a sound field sufficient to operate the hearing instrument at its maximum output level, with the hearing aid (and its acoustic coupling) in place and turned on, with the gain adjusted to full-on or just below feedback). In most cases, in a well characterized system it is possible to determine the signal processing parameter values that provide the target electro acoustic performance. Translating between signal processing parameter values and target electroacoustic performance may be done using a lookup table or translation function. The desired electroacoustic performance can be returned in a wide variety of formats such as input-level gains and frequency-specific insertion gains. The gains may be described for a quiet (50 dB SPL), moderate (65 dB SPL), and loud (80 dB SPL) speech shaped noise. For each level target insertion gain may be defined at 19 logarithmically spaced frequencies. There can be multiple instances of each prescription if a representative of subset of real-ear acoustics are added to each prescription.

The results of the statistical algorithm may be referred to as a representative data set. If the statistical algorithm is used, the representative data set is smaller than the full set of audiological values and may be more easily stored and transmitted among any combination of the computing device 100, the server 107, and the hearing assistance device 108. The representative data set may optimally encompass the values that are appropriate for the population. The statistical algorithm is optional.

FIGS. 4-7 provide at least one example of a dimension reduction algorithm performed on the representative data set that encompasses the audiological values for the population or directly on the set of audiological values. When the optional statistical algorithm described above for modifying the full set of audiological values to the representative data set is a dimension reduction algorithm, two dimensional reduction algorithms are used. The dimension reduction algorithm may be performed by the server 107, the hearing assistance device 108, or the computing device 100. Dimensionality reduction refers to a series of techniques from machine learning and statistics in which a number of cases, each specified in high-dimensional space are transformed to a space of fewer dimensions. The transformation can be linear or nonlinear, and a wide variety of techniques exist including (but not limited to) principal components analysis, factor analysis, multidimensional scaling, artificial neural networks (with fewer output than input nodes), self-organizing maps, and k-means cluster analysis. Similarly, perceptual models of psychophysical quantities (e.g., 'loudness') can also be considered dimension reduction algorithms. The exemplary embodiments described here focus on principal components analysis but any example technique may be used.

FIGS. 4-7 illustrate a dimension reduction algorithm applied to target insertion gain. However, the data may be arranged according to any sound characteristic or auditory model that is meaningful to the non-technically-advanced user. Examples of these types of audio characteristics include gain, loudness, and brightness.

Loudness may be the perceived intensity of sound. Loudness may be subjective as a function of multiple factors including any combination of frequency, bandwidth, and duration. An example signal may be passed through each of the signal processing values combinations (e.g., representative data set). Each output may be passed through a model of loudness perception. Loudness is a subjective quantity that is related to the overall sound level of a signal. A model of loudness perception takes as an input an arbitrary signal, and outputs a value of estimated loudness for that signal. That estimation is often based on a model of the auditory system that uses a filterbank (e.g., an array of bandpass filters) and a non-linear transformation of the filterbank output. If multiple example signals are used, then a statistical feature (e.g., the mean, mode, or median) may be used to describe the loudness associated with each element of the representative data set, establishing a single loudness value for each element of the representative data set, thereby reducing the number of dimensions describing each element.

Brightness may be a subjective dimension of sounds defined by perceived distinctions between sounds. Brightness may be a function of relative sounds and background noise, recent sounds, intensity, and other values. As with loudness, brightness is a subjective quantity that is related to the spectral tilt. A model of brightness perception takes as an input an arbitrary signal, and outputs a value of estimated brightness for that signal. As above, each output may be passed through a model of brightness based on user perception and then placed along that dimension. Alternatively, the model of brightness may be an objective metric of brightness based on differences in high and low frequency gain. Either example may establish a brightness value for each element in the representative data set.

Gain may be an objective dimension defined by the decibel ratio of the output signal of the hearing assistance algorithm to the input of the hearing assistance algorithm. The gain may be an across-frequency average measure of gain as a dimension on which each element is organized, establishing an overall gain value for each element of the representative data set.

Figure 4:
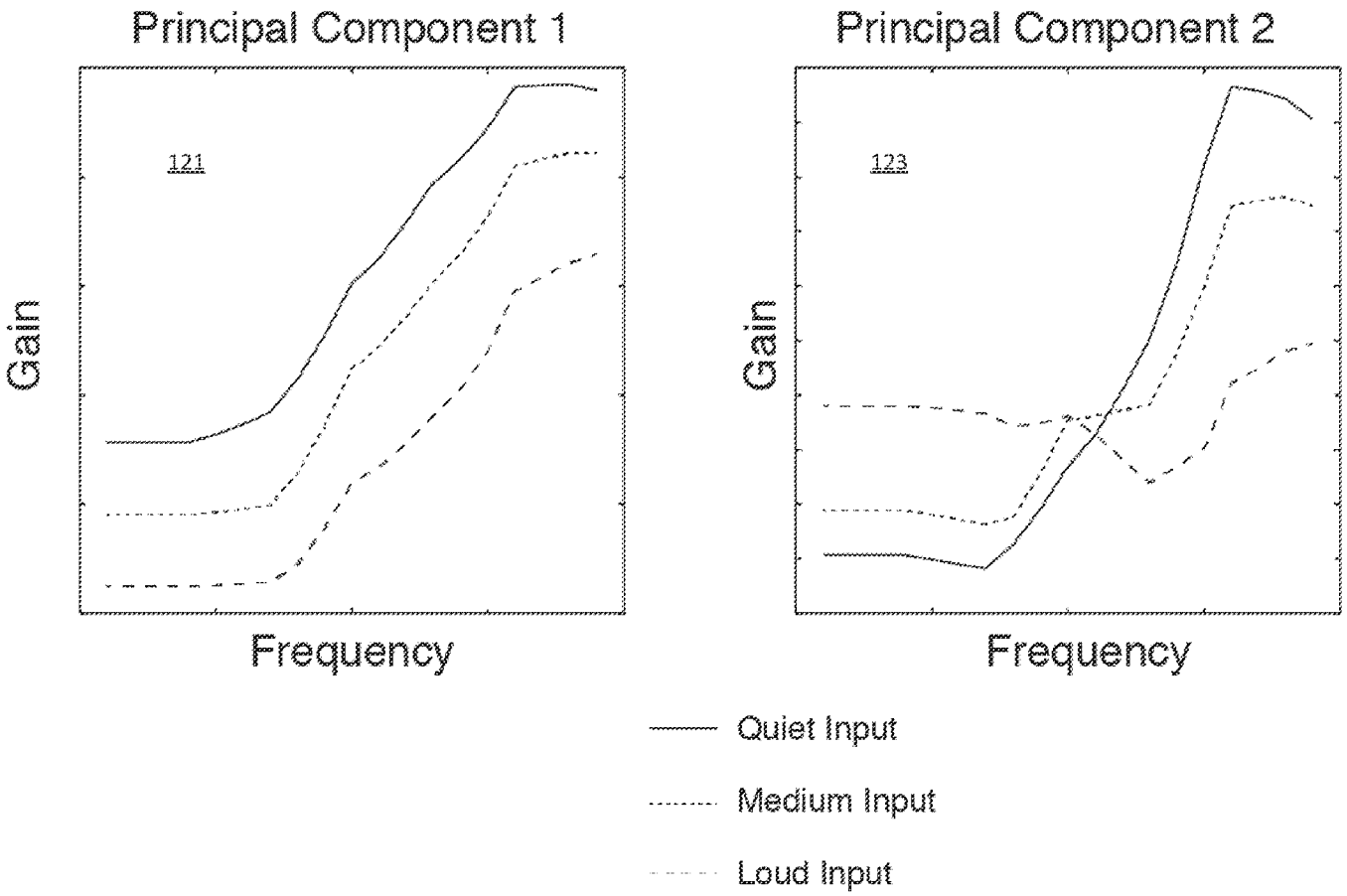
FIG. 4 illustrates an example component analysis for the system for hearing assistance device control.

FIG. 4 illustrates an example principal component analysis for the system for hearing assistance device control. This principal component analysis may relate to a primary control for the hearing assistance algorithm. In principal component analysis, the representative data set (or the audiological values when the statistical algorithm is omitted) is converted to principal component values that can be combined in a linear combination to represent the reduced set of data. The principal components are a space of reduced dimensions. In such cases, a further reduced dimension may be created via one or more trajectories through the space. In these examples, two principal components are used, but additional principal components or only one principal component may be used. In the case where one principal component is used, the trajectory can be a linear scaling of that component.

In FIG. 4, chart 121 illustrates a first principal component of the representative data set and chart 123 illustrates a second principal component of the representative data set. The principal components may be described as a function of frequency on one axis, and as a function of gain on the other axis. The principal components may be arrays of multiple data values.

Principal components analysis may refer to a statistical procedure in which high-dimensional data are reduced to a weighted combination of arrays, known as components. The components are orthogonal (uncorrelated) to each other, and each component has the same number of dimensional as the input data. The first component describes a portion of the variance in the data, and each subsequent component describes a portion of the remaining variance—as long as it is orthogonal to the preceding components. The first component may be maximized to capture as much of the variance as possible, and the second component may be maximized to capture as much of the remaining variance as possible. Identification of components can be accomplished via eigenvalue decomposition of a data covariance matrix or by singular value decomposition of a data matrix. The dimension reduction occurs because each data point is expressed as an array of weights (sometimes call 'component scores'), and the number of weights needed to describe a data point is less than the number of dimensions of that data point. Factor analysis is very similar to principal components analysis except that is uses regression modeling to generate error terms and therefore test hypothesis.

In multidimensional scaling, items expressed as a distance matrix between items in an example data set. A multidimensional scaling algorithm attempts to arrange those items in a low-dimensional space such at that the distances in the matrix are preserved as well as possible. The number of dimensions may be specified before analysis begins. A wide range of specific mathematical techniques can be used, all of which focus on minimizing the error between the input distance matrix and the observed distance matrix in the multidimensional scaling output.

An artificial neural network is primarily a machine learning technique in which there are one or more nodes that receive an input from a data set, and one or more nodes that produce an output. There also might be intermediate layers of nodes (often called hidden layers). A neural network typically tries to adjust the weights between nodes to best match the target output. If there are fewer output nodes than input nodes, then an artificial neural network can be considered a dimension reduction algorithm.

The list of dimension reduction techniques described above is not exhaustive but are included to illustrate the numerous ways a data set comprised of high-dimensional points can, through computational techniques, be reduced to a lower-dimensional space.

Figure 5:
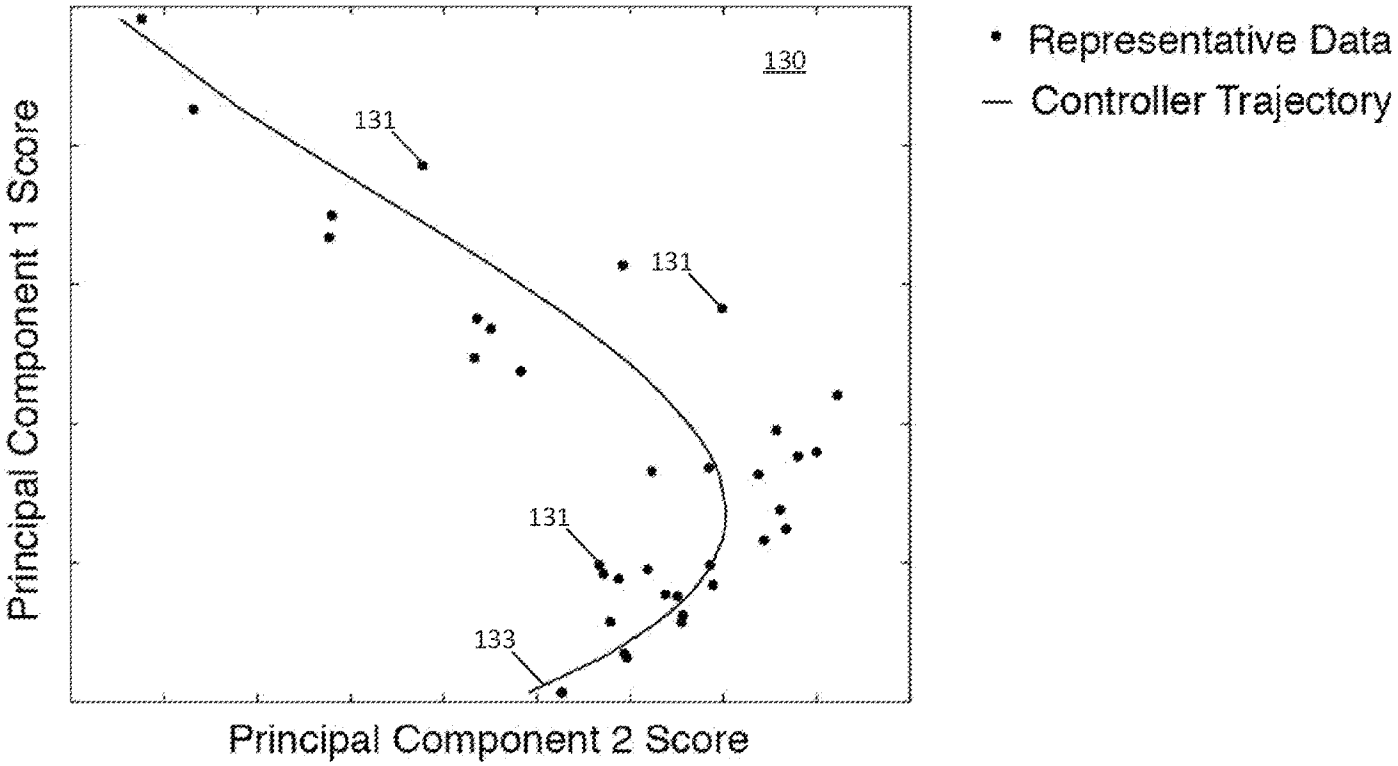
FIG. 5 illustrates an example trajectory for the component analysis of FIG. 4.

The chart 121 may include a single principal component with target gains across frequency concatenated across quiet (50 dB SPL (decibel sound pressure level)), medium (65 dB SPL), and a loud (80 dB SPL), inputs. Various limits may be placed on the input ranges. In some cases (e.g., FIG. 4) the frequency vs gain function will vary across input level. In other cases (e.g., FIG. 6) that function will be constant across input levels. FIG. 5 illustrates a chart 130 including an example trajectory 133 for the principal component analysis of FIG. 4. As shown by Equation 1, each value in the array $R_n$ of the representative data set may be described using a linear combination of the first principal component ($PC_1$) and the second principal component ($PC_2$), where $PC_1$ and $PC_2$ include an array of values, each value corresponding to a particular frequency and input level. For example, to arrive at any value of the array $R_n$ the corresponding first principal component ($PC_1$) is multiplied by a first component score ($S_1$) and the second principal component ($PC_2$) is multiplied by a second component score ($S_2$).

$$R_n = PC_1 * S_1 + PC_2 * S_2 \quad \text{Eq. 1}$$

Each of the data values 131 in the chart 130 corresponds to one of the data values of $R_n$. The vertical axis of chart 130 corresponds to the first component score ($S_1$) and the horizontal axis corresponds to the second component score ($S_2$).

The trajectory 133 is a single dimension trace of the two-dimensional data 131. Any point on the trajectory 133 is an estimation of the data 131. Some of the data 131 may intersect the trajectory 131 directly, while other points are spaced from the trajectory. The representative data set is further reduced to a single dimension of points along trajectory 133. The single dimension is meaningful to the user because it follows the empirical data collected from users regarding the signal processing parameters. Each data value of the representative dataset has some location along a new dimension that is meaningful to the user.

The trajectory 133 may be defined by fitting a curve to the data 131. Curve fitting refers to a wide variety of techniques in which the curve, or mathematical function that best fits a particular data set is identified. Curve fitting may involve either interpolation to fit a curve to the data or smoothing in which a smoothing function is constructed that approximately fits the data. Curve fitting via interpolation can follow a wide variety of mathematical forms including (but not limited to) polynomials, sinusoids, power, rational, spline, and Gaussian. Smoothing can also take a wide variety of forms including but not limited moving average, moving median, loess, and Savitzky-Golay. The embodiment Illustrated in FIG. 5 focuses on a third-order polynomial.

Each point along the trajectory 133 may be associated with an array of signal processing values. In one example, a function may be fit between the position on the trajectory 133 and the corresponding parameter value. Then the values are computed at each of the desired dimension positions. In another example, a set of target dimension positions along the trajectory 133 may be identified. For each target position a set of signal processing parameters values may be identified. If there are already values in the data 131, those values are used. Otherwise, other values (the full set or just nearby points) may be used to interpolate a value for the target position.

In a simple technique, a predetermined number of nearby data points are used to interpolate the new values (e.g., nearest 2 values, nearest 10 values, or another number of nearby values). In a more complex technique, all of the values of the data 131 may be used to interpolate the new values. In either example, the interpolation may be accomplished using functions such as linear, cubic, and/or spline interpolation. The resulting trajectory 133 describes a set of signal processing parameters across a sampling of the new dimension.

In another example, a function of the loudness level (in Sones) is calculated for each representative output. The target gain values can be calculated for each Sone value at a 1-Sone resolution. For each Sone value, if there was a representative output with that value, the target gain associated with that representative prescription may be used. If there was no modal output at that Sone value, the target gain may be determined using linear interpolation between the nearest lower and higher modal prescription values. This provides a continuum in which each position corresponded to target gains that were frequency and input level specific. The continuum may define a lookup table in which the user changes the Sone value (by moving a "loudness" setting) and the associated signal processing parameter values are updated in real time. The compression time constants may be set to the same value (e.g., 1 ms attack, 100 ms release).

Figure 6:
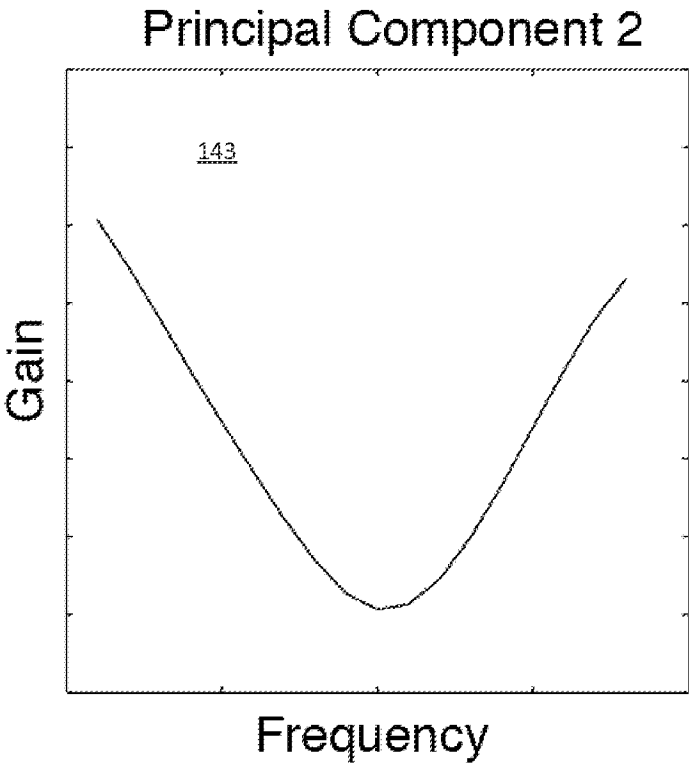
FIG. 6 illustrates another example component analysis for the system for hearing assistance device control.
Figure 6:
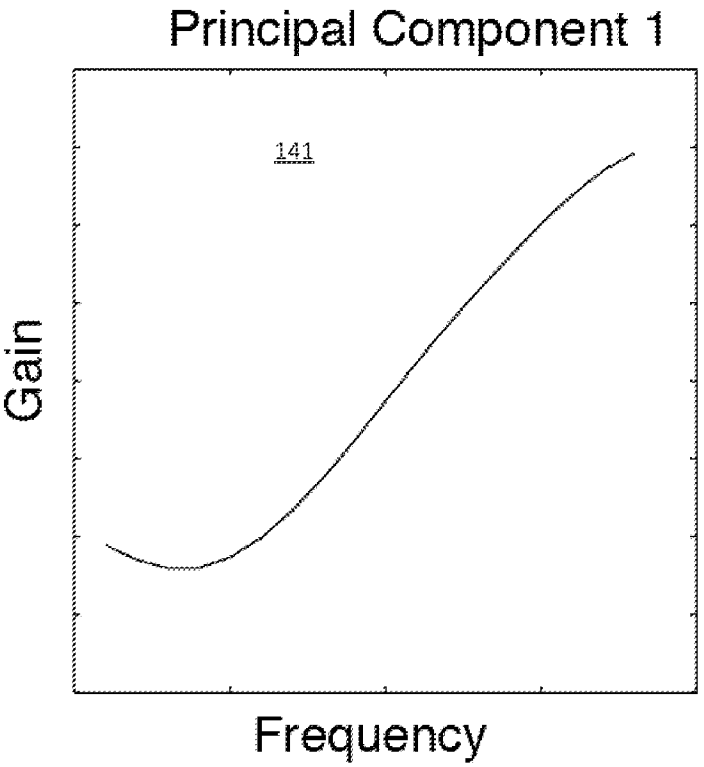

FIG. 6 illustrates another example principal component analysis for the system for hearing assistance device control. A chart 141 illustrates a first principal component of the representative data set and chart 143 illustrates a second principal component of the representative data set. This principal component analysis may relate to a secondary control, or fine tuning control, for the hearing assistance algorithm, and the principle component analysis of FIGS. 4 and 5 may relate to a primary control for the hearing assistance algorithm.

The fine tuning control or tone controller may be based on patient surveys or other empirical data. Common patient complaints from clinical hearing aid fittings may describe adjustments made during the fine-tuning process in response to patient complaints. In one example, the four most common complaints that the fitting experts associated with frequency spectrum are "Tinny," "Sharp," "Hollow." and "In a Barrell/Tunnel/Well".

A NAL prescription for an individual may be modified by a series of frequency-gain curves, and rated the extent to which each modification captured the meaning of each descriptor. Descriptor-to-parameter mapping may be accomplished using a regression-based technique in which a weight is computed for each frequency band that indicated the relative magnitude and direction of how gain in that band influences perception of the descriptor.

In one example, the principal components analysis conducted on the entire set of weighting functions (across all patients and all descriptors) revealed that the full range of variation in weighting functions could be captured well by a small number of components. The first component accounted for 78.4% of the variance in weighting function shape, and was a gradual spectral tilt spanning roughly 0.5-3 kHz that had a crossover frequency near 1.2 kHz and a slight peak near 3 kHz. The second component accounted for an additional 17.2% of the variance and was Gaussian-shaped with a wide bandwidth centered near 1.3 kHz, adjusting the middle and low/high extreme frequencies in opposite directions. In this example, two principal components account for 95.6% of the variance in the data. After principal components analysis, each weighting function in the entire set could be described as a weighted combination of the two identified components. If additional principal components are used, the accounted for variance may approach 100%.

Figure 7:
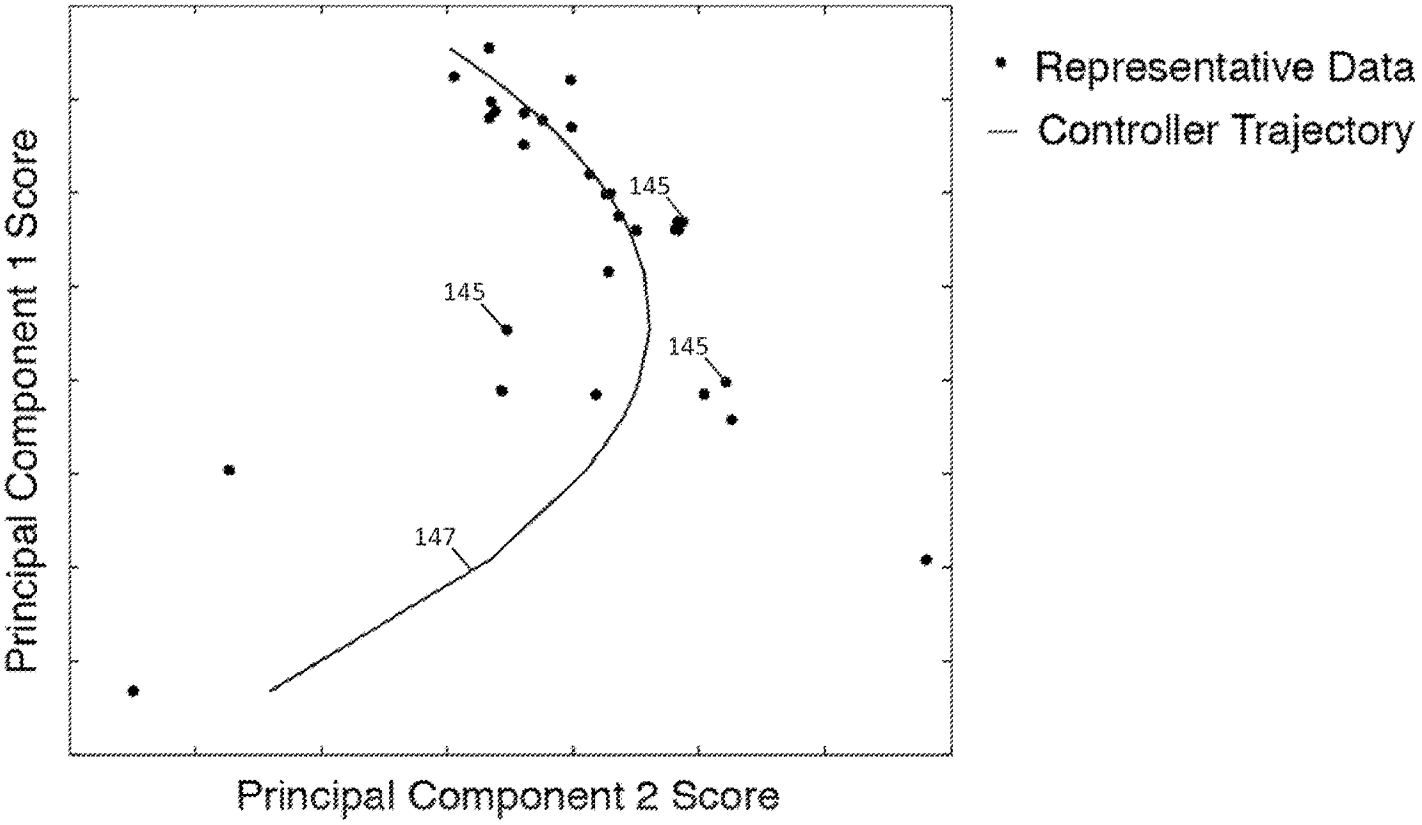
FIG. 7 illustrates an example trajectory for the component analysis of FIG. 6.

FIG. 7 illustrates an example trajectory 145 for the component analysis of FIG. 6. As shown by Equation 1 above, each value in the array $R_n$ of the representative data set may be described using a linear combination of the first principal component ($PC_1$) and the second principal component ($PC_2$). For example, to arrive at any value of the array $R_n$ the corresponding first principal component ($PC_1$) is multiplied by a first component score ($S_1$) and the second principal component ($PC_2$) is multiplied by a second component score ($S_2$).

The trajectory 147 is a single dimension trace of the two-dimensional data 145. Any point on the trajectory 147 is an estimation of the data 145. The trajectory 147 may be calculated or estimated using any of techniques described above.

In addition, in some cases there might be undesirable non-monotonic variation in parameter values across the dimension (e.g., an increase then decrease in gain at a particular frequency). In this case a variety of smoothing techniques can be used. Example smoothing techniques include a moving-average smoothing technique, in which a window size for the smoothing technique is increased until a threshold (e.g., monotonicity) is reached. In addition or in the alternative, loss (linear or quadratic) smoothing may be used.

The trajectories 133 and/or 147 describe a new dimension and positions along that dimension correspond to a set of signal processing parameter value combinations that is representative of the combinations that are regularly observed in a population of interest.

Figure 8:
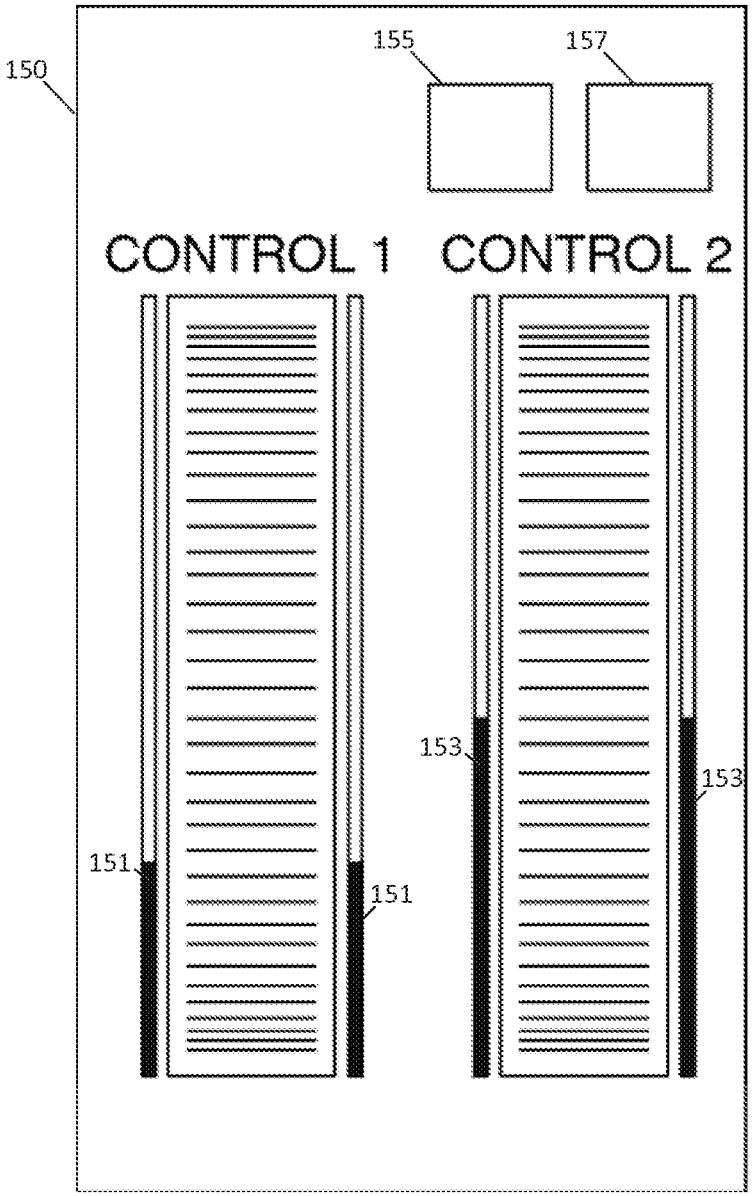
FIG. 8 illustrates an example user interface for the system for hearing assistance device control.

FIG. 8 illustrates an example user interface 150 for the system for hearing assistance device control. The user interface includes a first control device (CONTROL 1) and a second control device (CONTROL 2). The first control device may be associated with the primary control for the hearing assistance algorithm as described above with reference to FIGS. 4 and 5. The second control device may be associated with the secondary control (e.g., fine tuning) for the hearing assistance algorithm as described above with reference to FIGS. 6 and 7. As the first control device is rotated or otherwise actuated, the hearing assistance algorithm uses a set of signal processing parameters that corresponds to a location along the trajectory 133. As the second control device is rotated or otherwise actuated, the hearing assistance algorithm modifies the signal processing parameters along the trajectory 147.

Either or both of the first and second control devices may be limited to a single degree of freedom. The single degree of freedom may be provided by a touchscreen control, which may be a dial as shown by FIG. 8, a rotary knob, a slider, a scroll bar, or a text input. A position of the touchscreen control may correspond to a scaled value in a predetermined range (e.g., 1 to 10). The single degree of freedom may be provided by a physical control device. Example physical control devices include a knob, a dial, or up and down buttons for scrolling the scaled value in the predetermined range. Each data value of the predetermined range corresponds to a location along the respective trajectories 133 and 147.

The first control device may be associated with a meter level 151, and the second control device may be associated with a meter level 153. The left and right sides of the meter might refer to the controller positions associated with the left and right ears.

The user interface 150 may include a user information input 155 and a configuration input 157. The user information input 155 may allow the user to include demographic information such as birthday, birth year, gender, name, location, or other data), and hearing information such as duration of past hearing loss, degree of past hearing loss. Example degrees of past hearing loss may be textual or numeric (e.g., (1) no trouble, (2) a little trouble, (3) some trouble, or (4) severe trouble).

The configuration input 157 may include tuning options for making adjustments to the hearing assistance algorithm. For example, the configuration input 157 may allow the user to report performance of the hearing assistance algorithm. The configuration input 157 may include a communication option for requesting service or technical support.

Figure 9:
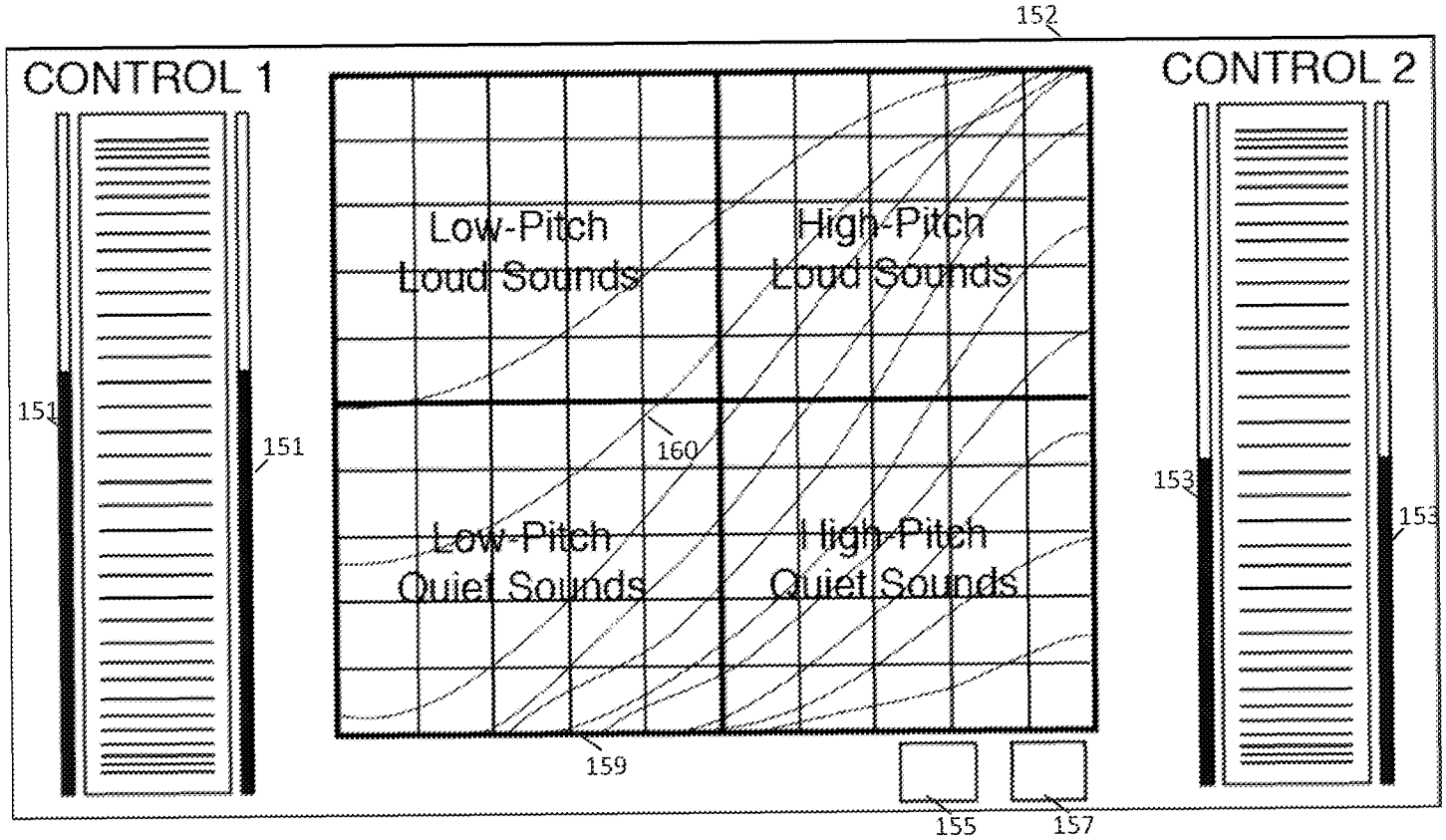
FIG. 9 illustrates another example user interface for the system for hearing assistance device control.

FIG. 9 illustrates another example user interface 152 for the system for hearing assistance device control. The user interface 152 may include any combination of the components described for user interface 150. The user interface 152 may also include a grid 159 that represents the current signal processing parameters for the hearing assistance algorithm. The grid 159 may include regions or quadrants that represent the pitch and loudness of the spectrum of sounds amplified by the hearing assistance algorithm. Examples include low pitch and loud sounds, high pitch and loud sounds, low pitch and quiet sounds, and high pitch and quiet sounds. The grid may include treble to base on one axis and quiet too loud on another axis. The grid 159 describes the acoustics of the input signal in terms of the input level for different frequency bands.

Each of the isolines 160 may differentiate regions for which the same amount (or similar amounts) of gain are applied. The isolines 160 may be spaced by a predetermined gain level, which may be linear or logarithmic. An example spacer may be 1 decibel, 3 decibels, or 10 decibels.

The user interfaces 150 and 152 may correspond to the computing device 100 or hearing assistance device 108 described with FIGS. 1A-B and 2A-B. Various scenarios are possible. The user may manipulate user interfaces 150 and 152 that exists either on a mobile device (e.g., phone, tablet, wearable computer), a personal computer, or on the hearing assistance device itself. Through one of several interaction paradigms described below (see "user interaction paradigms"), the user may select a position along the new dimension or trajectories described above. That position may be translated into a set of signal processing parameter values (either on the mobile device or on the hearing assistance device). The values may be sent to the hearing assistance device (through a wired or wireless connection, if not on the device itself) and may be updated in real time. Data may flow from the mobile device using the user interfaces 150 and 152 to parameter translation, which is sent to the hearing assistance device. In another embodiment, set of controller positions are sent from the mobile device to the hearing assistance device, and the hearing assistance device performs the parameter translation.

The control devices that are used manipulate the signal processing parameters along the dimension-reduced continua can be used in a variety of clinical/non-clinical settings. In one example, the hearing assistance algorithm is adjusted in conjunction with a clinician, but with free exploration. A clinician may provide an initial suggestion of control device positions. However, the user is free to manipulate the control device during everyday lives. The interfaces 150 and/or 152 may also include a simple method (e.g., a button to reset or load default settings) to return to the clinician-recommended setting.

In another example, the hearing assistance algorithm is adjusted in conjunction with a clinician, but within a restricted range. A clinician can limit the range of potential control device positions. The user can manipulate the control devices in their everyday lives, but only with a range that the clinician determines to be acceptable. In another example, the hearing assistance algorithm is adjusted in which the clinician provides a recommendation and limits the range of potential control device positions.

In another example, the hearing assistance algorithm is adjusted by the user alone. The user does not interact with a clinician for adjusting the hearing assistance algorithm. The user is able to freely manipulate control devices to the full extent in their everyday lives. In another example, the hearing assistance algorithm is adjusted by the user alone but with restrictions. The user does not interact with a clinician for adjusting the hearing assistance algorithm. The user may manipulate control devices in a restricted range determined by diagnostic or aesthetic criteria.

In another aspect, user interaction paradigms are used. The term, "selection" describes when a control device is changed from an inactive state (it does not change its value in response to user input) to an active state (it does change its value to user input). The term, "manipulation" describes when the position along the new dimension (described above) is being changed via a user interaction with the control device.

Selection can be accomplished by a variety of methods including touching with a finger or a stylus, clicking with a mouse cursor, looking at a control device in an eye-tracking paradigm, or using a voice command. Similarly manipulation can be accomplished by a variety of methods such as dragging a mouse cursor, dragging a finger or stylus, shifting gaze, or tilting a device containing an accelerometer, a gyrometer, or a magnetic sensor.

Selection and manipulation can be implemented in a variety of different control device paradigms. Aspects of selection and manipulation may include an absolute control device, a relative control device, an acoustical representation, or increase/decrease button. Using the absolute control device, interaction begins when a user selects a designated part of the control device (e.g., a slider head) and manipulates the position of that designated part (e.g., the length of a slider). Using the relative control device, interaction begins when a user selects any part of the control device. Movements relative to initial placement of a pointer are tracked to manipulate the position along the dimension, but there is no relationship between the absolute position of the pointer and the dimension position. This paradigm is especially useful for small screens (e.g., phones) and for users with poorer-than-normal dexterity.

Using acoustical representation is similar to the relative control device except that the control device is a representation of the current acoustical environment. The acoustical environment can be represented as a two dimensional blob in which frequency is on the x-axis and output level on the y-axis. The blob can represent the mean and variability of the output spectrum. The blob can also be one dimensional in which only the mean is displayed.

Using increase/decrease buttons, interaction begins when the user selects an endpoint of a continuum. A selection may manipulate the dimension position in the direction by a specified amount. A longer selection may gradually manipulate the dimension position toward the selected direction (e.g. the endpoints of a scroll bar). The dimension position selected by the user can be displayed in a number of different examples which may include a series of frequency versus gain curves, one for each input level.

Figure 10:
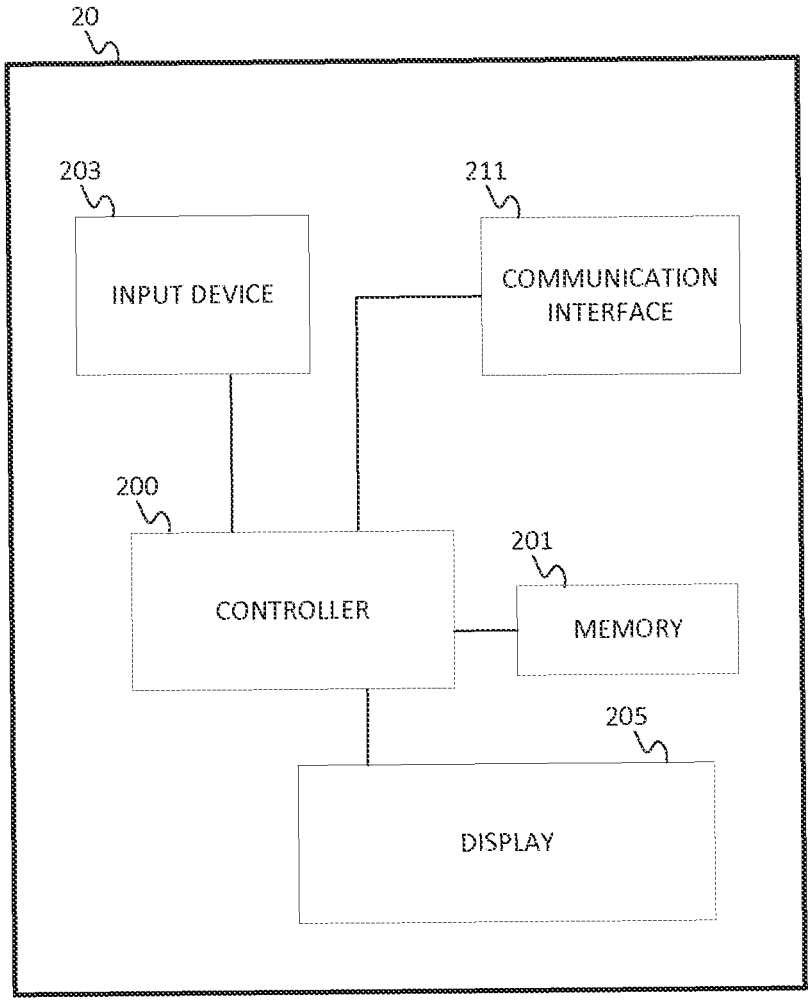
FIG. 10 illustrates an example device for the system of FIG. 1.

FIG. 10 illustrates an example device 20, which may be the computing device 100 or the hearing assistance device 108 of the system of FIG. 1. The device 20 may include a controller 200, a memory 201, an input device 203, a communication interface 211 and a display 205. As shown, in FIGS. 1A-B and 2A-B, the device 20 may also include the microphone 103 and the speaker 105. Additional, different, or fewer components may be provided. Different devices may have the same or different arrangement of components.

The display 205 may include a touchscreen or another type of user interface including at least one control input for settings of a hearing assistance device. The display may include either of the user interface 150 or user interface 152 described above. The user interface may include only one of the control devices. For example, the user interface may only include the primary control (e.g., loudness control) only the secondary control (e.g., fine tuning control) or a combination of both.

The controller 200 is configured to translate data from the at least one control input to one or more positions along a trajectory of a reduced data set. The trajectory may be any of the curve fittings or interpolated paths described above. The reduced data set may be derived from a set of audiological values for a population. Alternatively, the reduced data set may be the trajectory directly derived from the full set of audiological values for the population. In either case, the trajectory includes less dimensions that the reduced data set and less dimensions that the audiological values.

The at least one control input may be a dimension-reduced controller (DRC) designed using a principled, data-driven approach that makes the most common combinations of parameter values easily accessible to the user with two easily-understandable controllers ("loudness" and "tone"). The user is allowed to modify a wide range of signal processing parameters with controllers that simultaneously modify many parameter values through a single dimensional control input.

The memory 201 is configured to store preset settings for the hearing assistance algorithm. Separate preset settings may be stored for a typically shaped mild hearing loss, settings for a typically shaped moderate loss, settings for a typically shaped severe hearing loss, or settings for a typically shaped profound hearing loss.

The display 205 may include an input for the user to save the current signal processor parameters in memory 201. The controller 200 may include instructions for saving and recalling control device positions. If the user wishes to return to the current settings, the user can 'save' them. The saved data can contain any or all of the following: the current signal processing parameter values, the current controller positions, the current dimension positions, statistics/recordings of the current acoustic environment, statistics/recordings of the current hearing aid output (or estimated output), or the like. The saved data can reside on the mobile device, personal computer, hearing assistance device, or on a remote server.

To recall the settings, the user may receive the saved data from the stored location. If the stored data contains the signal processing parameters, then those can be directly implemented in the hearing assistance device 108. If the stored data contains acoustic features, then one of the devices may first run an optimization routine to identify the combination of signal processing parameters that best match the target output acoustic features or the features of the target manipulation. Data for the hearing aid fitting device could flow in various ways, which may include (1) mobile device to remote server to mobile device to hearing assistance device, (2) hearing assistance device to remote server to hearing assistance device, (3) mobile device to hearing assistance device, or (4) hearing assistance device.

Figure 11:
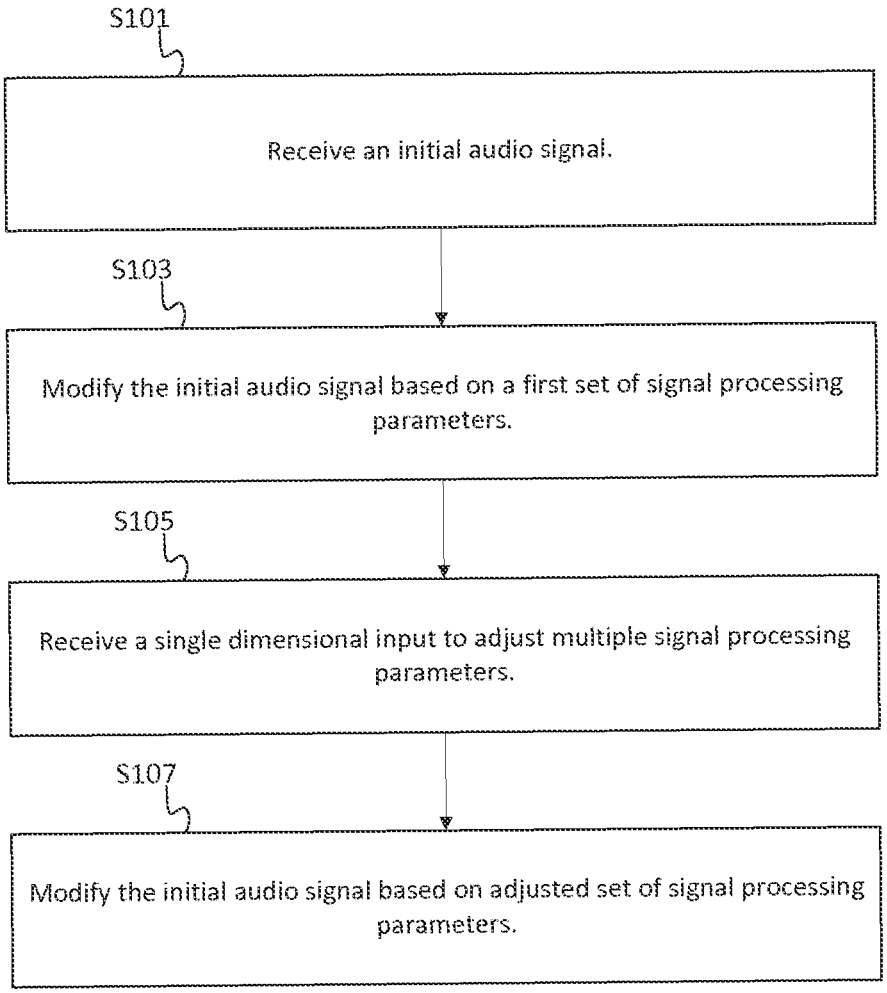
FIG. 11 illustrates an example flowchart for the device of FIG. 10.

FIG. 11 illustrates an example flowchart for the example device of FIG. 10. Additional, different, or fewer acts may be provided. The acts are performed in the order shown or other orders. The acts may also be repeated.

At act S101, the microphone 103, the controller 200, or the communication interface 211 may receive an audio signal. The audio signal may include speech, noise, television, radio sounds, or other sounds. At act S103, the controller 200 is configured to modify the audio signal according to a first set of signal processing parameters. The controller 200 may output amplified audio signals to the speaker 105 based on the first set of signal processing parameters.

At act S105, the display 205, the controller 200, or the communication interface 211 may receive data from a single dimensional input to adjust the subset or all of the first set of signal processing parameters. At act S207, the controller 200 is configured to modify the audio signal according to the adjusted set of signal processing parameters.

The input device 203 may be one or more buttons, a keypad, a keyboard, a mouse, a stylus pen, a trackball, a rocker or toggle switch, a touch pad, a voice recognition circuit, or other device or component for inputting data to the device 20. The input device 203 and the display 211 may be combined as a touch screen, which may be capacitive or resistive. The display 211 may be a liquid crystal display (LCD) panel, light emitting diode (LED) screen, thin film transistor screen, or another type of display. The display 211 is configured to display the first and second portions of the content.

Figure 12:
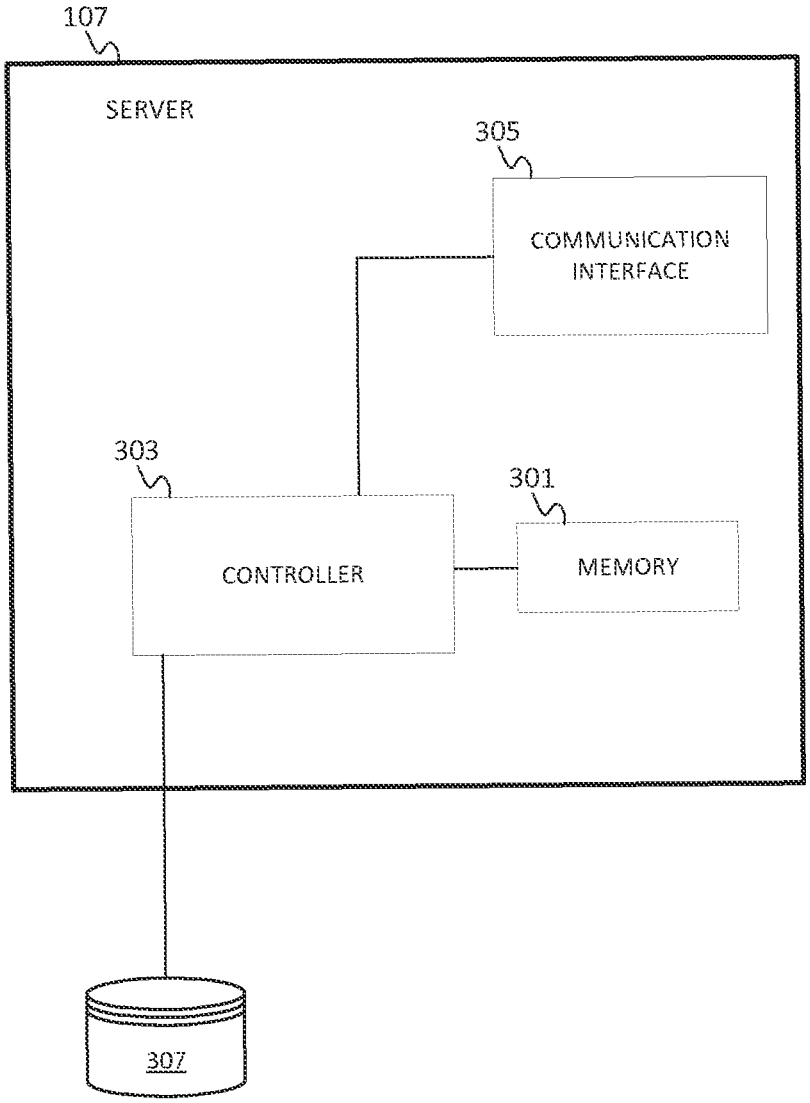
FIG. 12 illustrates an example server for the system of FIG. 1.
Figure 13:
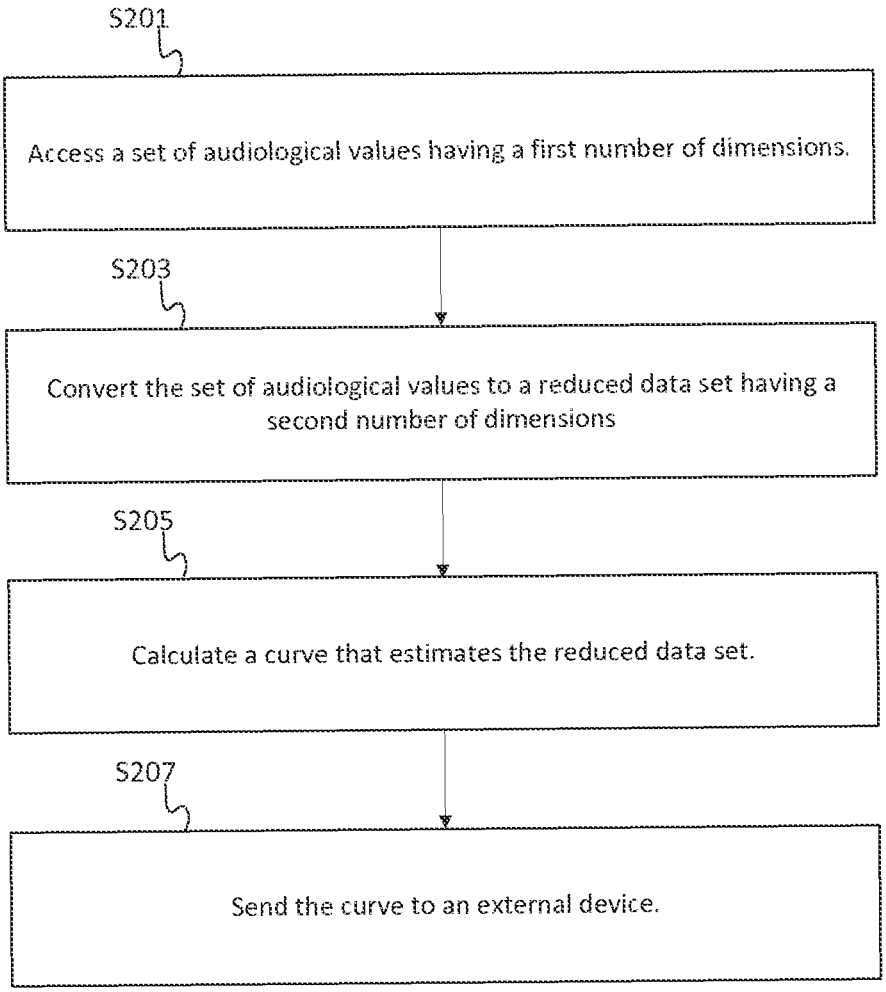
FIG. 13 illustrates an example flowchart for the server of FIG. 12.

FIG. 12 illustrates an example server 107 for the system of FIG. 1. The server 107 includes at least a memory 301, a controller 303, and a communication interface 305. In one example, a database 307 stores any combination of initial audiological values, reduced audiological values, signal processing parameters, stored signal processing settings, or other data described above. Additional, different, or fewer components may be provided. Different network devices may have the same or different arrangement of components. FIG. 13 illustrates an example flowchart for the server 107. Additional, different, or fewer acts may be provided. The acts are performed in the order shown or other orders. The acts may also be repeated.

At act S201, the controller 303 accesses a set of audiological values for a population from memory 301 or database 307. The set of audiological values may be a complete set of clinical measurements. The set of audiological values may be a statistically simplified set of clinical measurements. The set of audiological values has a first number of dimensions. In one example, the number of dimensions is two or higher. In one example, the number of dimensions may be much higher (e.g., greater than 100) because multiple independent variables are present in the set of audiological values.

In act S203, the controller 303 converts the set of audiological values to a reduced data set. The reduced data set has a second number of dimensions that is less than the first number of dimensions. The reduced data set may be derived from a principal component analysis or another dimension reducing technique.

In act S205, the controller 303 calculates a curve that estimates the reduced data set. The curve is fit to the reduced data set from the principal component analysis or another dimension reducing technique. The curve may have a single dimension because for any x-value on the curve there is exactly one y-value, or vice versa. The curve defines signal processing parameters for a hearing assistance algorithm.

In act S207, the communication interface 305 sends the curve to an external device, which applies the signal processing parameters to the hearing assistance algorithm. The external device may be a hearing assistance device or a mobile device, as described above. The external device may send a control input to move along the curve to modify the signal processing parameters for the hearing assistance algorithm.

The controllers 200 and 303 may include a general processor, digital signal processor, an application specific integrated circuit (ASIC), field programmable gate array (FPGA), analog circuit, digital circuit, combinations thereof, or other now known or later developed processor. The controllers 200 and 303 may be a single device or combinations of devices, such as associated with a network, distributed processing, or cloud computing.

The memories 201 and 301 may be a volatile memory or a non-volatile memory. The memories 201 and 301 may include one or more of a read only memory (ROM), random access memory (RAM), a flash memory, an electronic erasable program read only memory (EEPROM), or other type of memory. The memories 201 and 301 may be removable from their respective devices, such as a secure digital (SD) memory card.

The communication interface may include any operable connection (e.g., egress port, ingress port). An operable connection may be one in which signals, physical communications, and/or logical communications may be sent and/or received. An operable connection may include a physical interface, an electrical interface, and/or a data interface.

While the computer-readable medium is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored. The computer-readable medium may be non-transitory, which includes all tangible computer-readable media.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by software programs executable by a computer system. Further, in an exemplary, non-limited embodiment, implementations can include distributed processing, component/object distributed processing, and parallel processing. Alternatively, virtual computer system processing can be constructed to implement one or more of the methods or functionality as described herein.

Although the present specification describes components and functions that may be implemented in particular embodiments with reference to particular standards and protocols, the invention is not limited to such standards and protocols. For example, standards for Internet and other packet switched network transmission (e.g., TCP/IP, UDP/IP, HTML, HTTP, HTTPS) represent examples of the state of the art. Such standards are periodically superseded by faster or more efficient equivalents having essentially the same functions. Accordingly, replacement standards and protocols having the same or similar functions as those disclosed herein are considered equivalents thereof.

A computer program (also known as a program, software, software application, script, or code) can be written in any form of programming language, including compiled or interpreted languages, and it can be deployed in any form, including as a standalone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and anyone or more processors of any kind of digital computer. Generally, a processor may receive instructions and data from a read only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Computer readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD-ROM and DVD-ROM disks. The processor and the memory can be supplemented by, or incorporated in, special purpose logic circuitry.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings and described herein in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

I claim:

1. A system comprising:

a display device configured to present a user interface including at least two control inputs each usable for selecting one of multiple selectable positions, wherein combinations of individual positions of the at least two control inputs each represents a combination of a plurality of parameters associated with settings of a hearing assistance device; and one or more processing devices configured to perform operations comprising:

receiving user-input indicative of a particular combination of positions of the at least two control inputs, the corresponding positions of the control inputs being selected from the multiple selectable positions in each, wherein the user-input is obtained via the user interface, accessing a representation of a mapping that maps each combination of positions of the at least two control inputs to a corresponding combination of the plurality of parameters, wherein the representation of the mapping includes a representation of a trajectory, different points on the trajectory each representing a different combination of the plurality of parameters;

determining, using the representation, a particular combination of the plurality of parameters that corresponds to the particular combination of positions of the at least two control inputs as indicated by the user input, and generating one or more control signals representative of the particular combination of the plurality of parameters, such that the one or more control signals are configured to cause adjustments to settings of the hearing assistance device.

2. The system of claim 1, wherein determining the particular combination further comprises:

providing, to a remote computing device, information representing the particular combination of positions indicated by the user input; and receiving, from the remote computing device, information representing the particular combination.

3. The system of claim 1, wherein the trajectory represents a curve fitted on to a data set, wherein each data point in the data set represents a plurality of parameters associated with settings of a corresponding hearing assistance device.

4. A method comprising:

presenting, on a display of a computing device, a user interface that includes at least two controls each usable for selecting one of multiple selectable positions, wherein combinations of individual positions of the at least two control inputs each represents a combination of a plurality of parameters associated with settings of a hearing assistance device;

receiving, via the user interface, user-input indicative of a particular combination of positions of the at least two control inputs, the corresponding positions of the control inputs being selected from the multiple selectable positions in each;

accessing a representation of a mapping that maps each combination of positions of the at least two control inputs to a corresponding combination of the plurality of parameters, wherein the representation of the mapping includes a representation of a trajectory, different points on the trajectory each representing a different combination of the plurality of parameters;

determining, using the representation, a particular combination of the plurality of parameters that corresponds to the particular combination of positions of the at least two control inputs as indicated by the user input; and sending, to the hearing assistance device, information representative of the particular combination of the plurality of parameters, such that the information is usable for adjusting settings of the hearing assistance device.

5. The method of claim 4, wherein determining the particular combination further comprises:

providing, to a remote computing device, information representing the particular combination of positions indicated by the user input; and receiving, from the remote computing device, information representing the particular combination.

6. The method of claim 4, wherein the trajectory represents a curve fitted on to a data set, wherein each data point in the data set represents a plurality of parameters associated with settings of a corresponding hearing assistance device.

7. A system comprising:

memory for storing machine-readable instructions; and one or more processors configured to execute the machine-readable instructions to perform operations comprising:

receiving a set of audiological values for each of a plurality of individuals in a population of hearing assistance device users, wherein each of the sets comprises values corresponding to a first number of parameters associated with settings of a corresponding hearing assistance device, determining a reduced data set corresponding to the set of audiological values for each of the plurality of individuals, wherein each of the reduced data sets comprises values corresponding to a second number of parameters, the second number being less than the first number, calculating a trajectory representative of a distribution of the reduced data sets in a space having number of dimensions equal to the second number, wherein different points along the trajectory represent corresponding settings for a hearing assistance device, and storing a representation of the trajectory on a storage device such that data corresponding to positions along the trajectory is available for providing to hearing assistance devices.

8. The system of claim 7, wherein determining the reduced data set comprises using a principal component analysis or self-organizing maps on the corresponding set of audiological values.

9. The system of claim 7, wherein the set of audiological values comprises one or more parameters that are based on an audiogram of the corresponding individual.

10. The system of claim 7, wherein the operations further comprise:

receiving from a remote computing device, data representing a controller position associated with a particular hearing assistance device;

determining based on the trajectory, settings of the particular hearing assistance device that correspond to the controller position; and providing the settings such that the settings are usable in adjusting the particular hearing assistance device.

11. The system of claim 7, wherein the operations further comprise:

transmitting, to a remote computing device, data representing the trajectory.

12. One or more machine-readable storage devices storing instructions executable by one or more processing devices to perform operations comprising:

presenting, on a display of a computing device, a user interface that includes at least two controls each usable for selecting one of multiple selectable positions, wherein combinations of individual positions of the at least two control inputs each represents a combination of a plurality of parameters associated with settings of a hearing assistance device;

receiving, via the user interface, user-input indicative of a particular combination of positions of the at least two control inputs, the corresponding positions of the control inputs being selected from the multiple selectable positions in each;

accessing a representation of a mapping that maps each combination of positions of the at least two control inputs to a corresponding combination of the plurality of parameters, wherein the representation of the mapping includes a representation of a trajectory, different points on the trajectory each representing a different combination of the plurality of parameters;

determining, using the representation, a particular combination of the plurality of parameters that corresponds to the particular combination of positions of the at least two control inputs as indicated by the user input; and sending, to the hearing assistance device, information representative of the particular combination of the plurality of parameters, such that the information is usable for adjusting settings of the hearing assistance device.

13. The one or more machine-readable storage devices of claim 12, wherein the trajectory represents a curve fitted on to a data set, wherein each data point in the data set represents a plurality of parameters associated with settings of a corresponding hearing assistance device.

14. The one or more machine-readable storage devices of claim 12, wherein determining the particular combination further comprises:

providing, to a remote computing device, information representing the particular combination of positions indicated by the user input; and receiving, from the remote computing device, information representing the particular combination.

* * * * *